US007188566B2

(12) United States Patent
Gladden

(10) Patent No.: US 7,188,566 B2
(45) Date of Patent: Mar. 13, 2007

(54) NON-ELECTRIC DETONATOR

(75) Inventor: Ernest L. Gladden, Granby, CT (US)

(73) Assignee: Dyno Nobel Inc., Salt Lake City, UT (US)

( * ) Notice: Subject to any disclaimer, the term of this patent is extended or adjusted under 35 U.S.C. 154(b) by 0 days.

(21) Appl. No.: 10/476,042

(22) PCT Filed: Apr. 23, 2002

(86) PCT No.: PCT/US02/12803

§ 371 (c)(1),
(2), (4) Date: Oct. 20, 2003

(87) PCT Pub. No.: WO02/085818

PCT Pub. Date: Oct. 31, 2002

(65) Prior Publication Data

US 2004/0200372 A1 Oct. 14, 2004

(51) Int. Cl.
*C06C 5/06* (2006.01)
*C06C 5/00* (2006.01)

(52) U.S. Cl. ..... 102/275.11; 102/275.6; 102/275.7; 102/275.9

(58) Field of Classification Search ..... 102/275.1–275.11, 202.13, 202.7, 202.14, 102/200
See application file for complete search history.

(56) References Cited

U.S. PATENT DOCUMENTS 2,558,134 A 6/1951 Hall
2,923,239 A 2/1960 Andrew et al.
3,338,165 A 8/1967 Minnick
3,367,266 A 2/1968 Griffith
3,640,222 A 2/1972 Graham
3,683,811 A 8/1972 Driscoll (Continued)

FOREIGN PATENT DOCUMENTS

CH 348091 7/1960

(Continued)

OTHER PUBLICATIONS

European Search Report; Applicaiton No. 02726794.7—2111; PCT/US0212803; Reference No. EP28921MA900kj;Date Jul. 21, 2005; 5 pages.

(Continued)

*Primary Examiner*—Michael J. Carone
*Assistant Examiner*—James S. Bergin
(74) *Attorney, Agent, or Firm*—Cantor Colburn LLP

(57) ABSTRACT

A detonator (10) has a constant-diameter shell (12) which has a significantly higher shell length-to-diameter (outside diameter) ratio than prior art detonators. The shell (12) is configured to hold an explosive output charge (18) which is cylindrical in configuration and has a charge L:D ratio which is greater than that of prior art constant diameter detonators. As a result, a significant portion of the output signal of the detonator is directed laterally and it is feasible to transfer signals to a plurality of receptor lines disposed along that portion of the length of the detonator which is co-extensive with the length of the explosive output charge (18). A connector block (26) is configured to hold at least one array of receptor lines in side-by-side arrangement along the side of the detonator (10), and transversely to the longitudinal axis of the detonator (10).

26 Claims, 3 Drawing Sheets

U.S. PATENT DOCUMENTS 3,789,759 A 2/1974 Jones
3,878,785 A 4/1975 Lundborg
3,995,526 A 12/1976 Shannon
4,080,902 A 3/1978 Goddard et al.
4,335,672 A * 6/1982 Krussig ..... 102/275.3
4,343,663 A 8/1982 Breza et al.
4,350,097 A * 9/1982 Bowman et al. ..... 102/275.2
4,369,688 A 1/1983 Yunan
4,369,708 A * 1/1983 Bryan et al. ..... 102/202.13
4,547,234 A 10/1985 Takeuchi et al.
4,660,474 A 4/1987 Dias dos Santos
4,714,017 A 12/1987 Kelly et al.
4,722,279 A * 2/1988 Yunan ..... 102/275.4
4,727,808 A 3/1988 Wang et al.
4,821,645 A 4/1989 Reiss
4,838,165 A 6/1989 Gladden et al.
4,898,095 A 2/1990 Tasaki et al.
4,938,141 A * 7/1990 Gallant ..... 102/275.4
5,171,935 A 12/1992 Michna et al.
5,204,492 A 4/1993 Jacob et al.
5,243,913 A 9/1993 Brent et al.
5,293,821 A 3/1994 True et al.
5,299,500 A 4/1994 Lindquist et al.
5,398,611 A 3/1995 Michna et al.
5,435,248 A 7/1995 Rode et al.
5,499,581 A 3/1996 Sutula, Jr.
5,501,151 A * 3/1996 Thureson et al. ..... 102/275.7
5,522,318 A 6/1996 Gladden et al.
5,631,440 A 5/1997 Thureson et al.
5,659,149 A 8/1997 Sutula, Jr.
5,665,932 A 9/1997 Viljoen et al.
5,703,319 A * 12/1997 Fritz et al. ..... 102/275.7
5,703,320 A * 12/1997 Lucca et al. ..... 102/275.7
5,747,722 A * 5/1998 Gladden et al. ..... 102/275.11
5,792,975 A 8/1998 Tseka et al.
5,810,098 A 9/1998 Wathen
5,880,399 A 3/1999 Hales et al.
5,939,661 A 8/1999 Bayliss
6,123,025 A 9/2000 Jacob et al.
6,173,651 B1 * 1/2001 Pathe et al. ..... 102/200
6,272,996 B1 * 8/2001 O'Brien et al. ..... 102/275.11
6,305,287 B1 * 10/2001 Capers et al. ..... 102/275.7
6,349,648 B1 2/2002 Capers et al.
6,425,332 B1 * 7/2002 Capers et al. ..... 102/275.7
6,513,437 B2 * 2/2003 Chan et al. ..... 102/275.7
6,578,490 B1 * 6/2003 Francisco ..... 102/275.11
6,694,886 B1 2/2004 Woodall et al.

FOREIGN PATENT DOCUMENTS

DE 30 10 067 A1 10/1981
WO WO 99/46221 9/1999
WO WO 99/53263 10/1999
WO WO 00/26603 5/2000

OTHER PUBLICATIONS

International Preliminary Examination Report issued in PCT/US02/12803, dated Oct. 28, 2005, 7 pages.

* cited by examiner

NON-ELECTRIC DETONATOR

BACKGROUND OF THE INVENTION

1. Field of the Invention

The present invention relates to detonators and, in particular, to non-electric detonators employed for transmitting initiation signals to receptor lines and to explosive charges.

2. Related Art

Detonators are commonly used not only to initiate explosive charges, e.g., booster charges, but also to initiate non-electric, impulse signals in signal lines such as low-energy detonating cords, shock tubes and low velocity signal tubes ("deflagration tubes") that carry the impulse signal to other devices. Conventional non-electric detonators comprise an output charge of explosive material packed in the closed end of a cylindrical shell, the other end of the shell having an input signal line connected thereto. Conventionally, the shell is crimped onto a bushing surrounding the signal line in the crimp region, to help secure the shell to the line and to close the open end of the shell in order to seal the interior of the shell against the environment. Some detonators include a pyrotechnic or electronic delay element between the output charge and the signal line to interpose a delay between the receipt of the initiation signal in the detonator and the release of the output signal by detonation of the output charge of the detonator. Upon receipt of an initiation signal from the signal line, the detonator is initiated and its output charge generates an explosive output signal that can be used to initiate signals in one or more receptor lines or to detonate an explosive charge. Numerous devices, commonly referred to as "connector blocks", are known in the art for holding receptor lines in signal-receiving relation to the explosive end of the detonator.

The explosive output charge in a detonator conforms to the interior of the detonator shell in which it is disposed and, inasmuch as the conventional detonator shell has a circular cross section, so too does the output charge. Accordingly, the explosive output charge will have a diameter defined by the interior diameter of the detonator shell. The length of the output charge refers to its depth in the shell. In prior art low-output detonators, the ratio of the length of the explosive charge to its diameter, sometimes below referred to as "the charge L:D ratio", is typically less than 1, and is commonly about 0.5:1 or less, resulting in a disc-like configuration. For example, a typical prior art detonator will have an outside diameter of about 0.28 to 0.295 inch (about 7.11 to 7.49 mm) and an inside diameter of about 0.26 inch (about 6.60 mm), resulting in the output charge having the same diameter, D, of about 0.26 inch (about 6.60 mm). The typical prior art output charge has a length L (measured along the longitudinal axis of the detonator) of about 0.1 inch (about 2.54 mm), resulting in a charge L:D ratio of about 0.38:1.

As a result of the disc-like configuration of the prior art explosive output charge, the output signal of a prior art detonator is strongest at the explosive tip at the axial end of the detonator and around the circumference of the detonator in the lateral region immediately adjacent the explosive tip. The effective lateral output region of a prior art detonator typically does not exceed a distance along the longitudinal axis of the detonator which is equal to the diameter of one usual-sized receptor line, e.g., shock tube or a low-energy detonating cord. Accordingly, most prior art connector blocks are configured to hold receptor lines only against the explosive tip of the detonator and at opposite sides of the detonator, immediately adjacent the explosive tip.

An exception to such placement of the receptor lines is shown in U.S. Pat. No. 6,349,648, issued to J. Capers et al on Feb. 26, 2002, which is a division of U.S. Pat. No. 6,305,287, issued to J. Capers et al on Oct. 23, 2001. The '648 Patent, like the '287 Patent, discloses a detonator and a connector block for holding the same in contact with a plurality of receptor lines. As best seen in FIGS. 1E, 2, 3 and 5, and as described starting at column 3, line 54, the detonator B is formed from a generally cylindrical metallic shell of circular cross-section, preferably formed from aluminum about 0.5 mm thick and shaped as shown in FIG. 5. Detonator B is comprised of a main cylindrical section 10, a smaller-diameter cylindrical explosive end portion 12, and a transition portion 14. The shell of detonator B is said to preferably be axisymmetric with respect to its longitudinal axis 15 (FIG. 5). The main (output) explosive charge of detonator B is located in explosive end portion 12 (FIGS. 6 and 7), and is distributed along the axial length of end portion 12 so as to initiate shock tubes D (FIG. 1B). The explosive force of the ignited main charge will ignite the shock tubes D held in place alongside the length of end portion 12. An initiating shock tube 16 is connected to the opposite signal end 18 of detonator B, as best seen in FIGS. 1E, 2 and 3.

The connector block, referred to as "block body A", is described starting at column 4, line 20 and is configured to hold a plurality of shock tubes D orthogonally to explosive end portion 12. As illustrated in FIGS. 6 and 7, and described at column 5, line 61 to column 6, line 62, various loadings of explosives such as PETN and dextrinated lead azide may be loaded within end portion 12. FIG. 6 shows the interposition of a small, fast-burning pyrotechnic charge 64, e.g., a zirconium/red lead mixture, placed on top of the main lead azide charge in order to "protect against explosion of the charges during subsequent loading operations." (Column 6, lines 13–17.) FIG. 7 shows an embodiment in which the PETN charge is filled to above the transition point between the small-diameter explosive end portion 12 and main cylindrical section 10. These expedients show attempts to deal with the difficulties inherent in loading the explosive and pyrotechnic components into the end of a detonator which transitions from a large diameter to a smaller diameter end portion.

SUMMARY OF THE INVENTION

In accordance with the present invention there is provided a non-electric detonator comprising the following components. A cylindrical shell defines a shell interior, the shell having a substantially constant outside diameter not greater than about 6 mm, e.g., about 3.3 to about 5.5 mm, a closed end and an opposite, open end. An explosive output charge is contained within the shell at the closed end thereof, the explosive output charge being in the shape of a cylindrical column and having a charge L:D ratio of from about 3 to about 20, or about 24, e.g., from about 4 to about 10, or from about 4 to about 12. A non-electric input signal transmission line is received and sealed within the open end of the shell and disposed in signal-transfer relationship with the explosive charge.

Another aspect of the present invention provides a non-electric detonator comprising the following components. A cylindrical shell defines a shell interior and has a length as defined below, the shell being of substantially constant outside diameter not greater than about 6 mm, and having a closed end and an opposite, open end. An explosive output charge is contained within the shell at the closed end thereof and a non-electric input signal transmission line is received and sealed within the open end of the shell and disposed in signal-transfer relationship with the explosive charge. The length of the shell is such that the ratio of its length to its diameter is from about 8 to about 23, e.g., from about 12 to about 20. For example, the length of the shell may be from about 25 to about 79 mm.

Various aspects of the present invention may provide one or more of the following features, alone or in combinations of two or more thereof. The explosive output charge may be in the shape of a cylindrical column having a charge length-to-diameter ratio of from about 4 to about 10; the explosive output charge may be in the shape of a cylindrical column having a length of from about 20 to about 26 mm; the explosive output charge may have a diameter of from about 2.5 to about 5 mm; the input signal transmission line may comprise shock tube; a delay train may be interposed between, and in signal-transfer relationship with, the explosive output charge and the input signal transmission line; the explosive output charge may contain an inert diluent; the explosive output charge may be in the shape of a cylindrical column and an attenuation sleeve may be disposed about at least a portion of the length of the explosive charge, with the attenuation sleeve being disposed either within the shell or on the exterior of the shell; the attenuation sleeve may extend over the entire length of the explosive charge; the input-signal transmission line may have an outside diameter which is substantially the same as the inside diameter of the shell; the detonator may further comprise a sealant disposed between the input signal transmission line and the inside wall of the shell and disposed to seal the shell interior from the environment.

Another aspect of the present invention provides a non-electric detonator comprising the following components. A cylindrical shell defines a shell interior and has a closed end and an opposite, open end, the shell being of substantially constant outside diameter not greater than about 6 mm, and of substantially constant inside diameter. An explosive output charge is contained within the shell at the closed end thereof, the explosive output charge having the shape of a cylindrical column having a length of from about 20 to about 26 mm and a diameter of from about 2.5 to about 5 mm. A non-electric input signal transmission line is received and sealed within the open end of the shell and terminates in an end disposed within the shell in signal-transfer relationship with the explosive charge.

In a related aspect of the present invention, a delay train may be interposed between, and in signal-transfer relationship with, the explosive charge and the input signal transmission line.

Other aspects of the present invention will become apparent from the following description.

Reference herein and in the claims to "constant diameter" or "substantially constant diameter" of the detonator shell means that the outside diameter of the shell is substantially the same along the entire length of the shell, from the closed to the open end thereof The definition therefore distinguishes over prior art detonators of the type illustrated in FIG. 1 and described below. The defined terms do not exclude detonator shells containing crimps or other such minor deformations, such as a slight taper to facilitate manufacturing operations.

DETAILED DESCRIPTION OF THE INVENTION

The present invention provides a detonator comprising a hollow shell closed at one end and open at the other and having a constant diameter which is significantly smaller than that of prior art constant diameter detonators. (Unless otherwise stated, all references herein and in the claims to the shell length-to-diameter ratio are to the outside diameter of the shell. As a result, the detonators of the present invention have a length-to-diameter ratio considerably higher than that of prior art detonators. The length of the detonators of the present invention is generally comparable to, and may be the same as, those of prior art detonators. The resulting "thin" detonators of the present invention thus have a configuration which inspires reference to them as "pencil" detonators. The explosive output charge contained at the closed end of such "pencil" detonators is necessarily configured to fit within the shell and, consequently, the explosive output charge has a high charge L:D ratio, i.e., the ratio of the length of the charge to its diameter. The diameter of the charge is, of course, limited by the inside diameter of the shell. The fact that the explosive output charge is contained within a shell of constant diameter obviates difficulties (discussed below) which are inherent in detonators which have a large and a small diameter section connected by a transition section, with the explosive output charge contained within the small diameter section.

Figure 1:
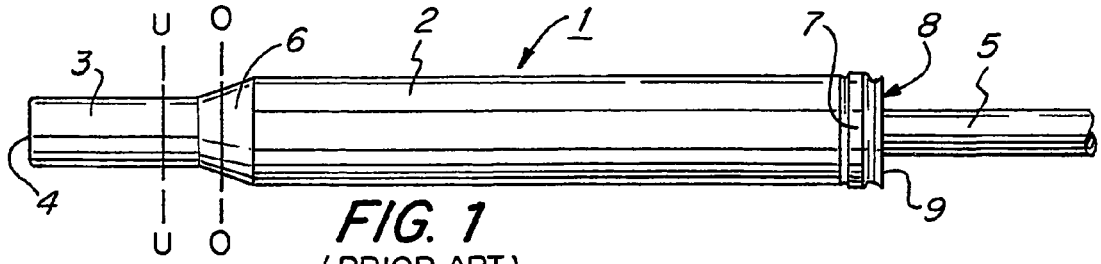
FIG. 1 (PRIOR ART)
FIG. 1 is a side elevation view of a detonator in accordance with the prior art.

Referring now to FIG. 1, there is shown a prior art detonator 1 comprised of a cylindrical metal shell having a cylindrical main section 2 and a smaller-diameter cylindrical end portion 3 which terminates in a closed end 4 and within which is contained the explosive output charge (not shown). A shock tube 5 enters the open end of the cylindrical main section 2 and extends therein in signal-transfer relation with a pyrotechnic delay train (not shown) contained within cylindrical main section 2. A transition portion 6 of the shell connects cylindrical main section 2 and cylindrical end portion 3. A crimp 7 at the open end 8 of cylindrical main section 2 secures a bushing 9 about shock tube 5 in order to seal the interior of the shell of detonator 1 against the environment. As described in detail in the above-mentioned U.S. Pat. Nos. 6,305,287 and 6,349,648, if the cylindrical end portion 3 is underfilled with the explosive outlet charge, a gap may result between the pyrotechnic delay train (or the end of the shock tube within the shell), which would decrease reliability of the detonator 1, as it might fail to fire because of the gap. An underfill situation would exist if the explosive output charge extended within cylindrical end portion 3 from closed end 4 thereof only to underfill line U—U. If an overfill situation exists, i.e., if the explosive output charge extends from closed end 4 to overfill line O—O, upon seating the pyrotechnic delay train or other components within cylindrical main section 2, the overflow explosive may be pinched between the decreasing diameter of transition portion 6 and the inserted pyrotechnic delay train or other component, thereby risking detonation of the explosive output charge during the assembly operation. Because the explosive output charge within cylindrical end portion 3 immediately adjacent transition portion 6 may be a particularly sensitive explosive, such as lead azide, overfilling presents a significant risk of detonation during assembly.

Figure 2:
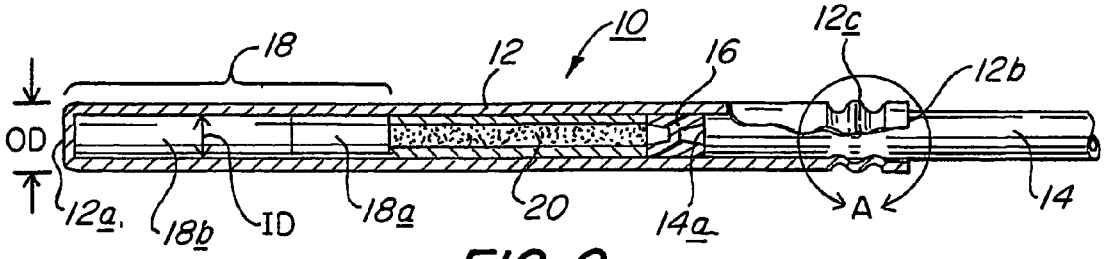
FIGS. 2 and 3 are schematic, cross-sectional side elevation views of (the same) detonator in accordance with a first embodiment of the present invention, FIG. 3 showing one array of signal receptor lines positioned in contact with the detonator.
Figure 3A:
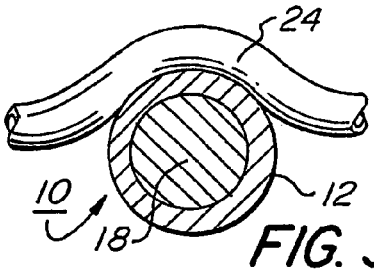
FIG. 3A is a cross-sectional view taken along line I—I of FIG. 3.
Figure 3:
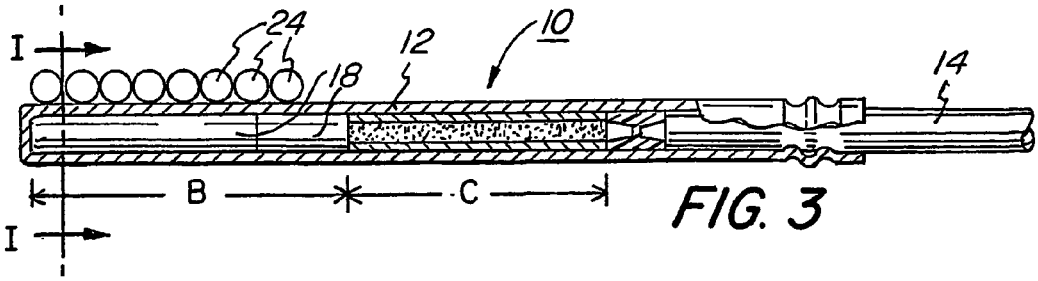

A detonator 10 in accordance with one embodiment of the present invention is shown in FIGS. 2 and 3 and comprises an elongate cylindrical shell 12 of substantially constant outside diameter OD and substantially constant inside diameter ID. Shell 12 is of circular cross section and has a closed end 12*a* and an opposite, open end 12*b*. Open end 12*b* is secured at crimp 12*c* to an initiation signal line which, in the illustrated embodiment, comprises a shock tube 14. Shock tube 14 terminates within shell 12 at end 14*a* thereof and abuts an isolation member 16 which provides a stand-off between the end 14*a* of shock tube 14 and the reactive materials in shell 12. As is well known, isolation member 16 also serves to inhibit the transfer of static electricity from shock tube 14 to the reactive or explosive materials within shell 12.

In the illustrated embodiment, a pyrotechnic delay train member 20 is interposed between isolation member 16 and explosive output charge 18. Charge 18 comprises a top or primary charge 18*a* and a base charge 18*b*. Primary charge 18*a* typically comprises a small quantity of a primary explosive material (e.g., lead azide, diazodinitrophenol, hexanitromannite, lead styphnate, etc.) that is sensitive to the signal it receives from pyrotechnic delay train member 20, which signal was generated by the signal emitted from end 14*a* of shock tube 14. As is well known in the art, shock tube 14 may be initiated by any suitable means, such as a spark generated at the end of shock tube 14 opposite from end 14*a*, or by a detonator or low-energy detonating cord utilized to initiate the signal in shock tube 14 from externally thereof. As is well known, pyrotechnic delay train member 20 is of a selected composition and length to provide a desired predetermined time lapse between emission of the signal from end 14*a* of shock tube 14 and initiation of explosive output charge 18. Delay train member 20 typically comprises a metal tube (lead, pewter or other suitable metal) having a core of compressed pyrotechnic material, or a pressed powder charge, as is well known in the art.

Base charge 18*b* typically comprises one or more secondary explosive materials (e.g., PETN, RDX, HMX, etc.). The cushion disc and buffer commonly employed in prior art detonators may be omitted or included as desired. Such components are well known in the art and are not illustrated or described in detail herein. When initiated by shock tube 14, primary charge 18*a* releases sufficient energy to initiate base charge 18*b*. The primary charge 18*a* may be omitted if the base charge 18*b* is sufficiently sensitive to the signal initiated by shock tube 14. Such a base charge may comprise one or more primary explosive materials or a combination of primary and secondary explosive materials.

Detonator 10 differs from prior art detonators in the high length-to-diameter ratio of shell 12 and the consequent high charge L:D ratio of explosive output charge 18. The charge L:D ratio of explosive output charge 18 may vary from about 4 to about 10. Usually, shell 12 is of circular cross section, so that the explosive output charge 18 is in the form of a column of circular cross section.

The overall length of shell 12 measured along the longitudinal axis thereof from closed end 12*a* to open end 12*b* is limited by two considerations. Because most detonator shells 12 are formed from aluminum by a drawing process, the maximum obtainable length is slightly more than 3 inches (76.2 mm), about 3.1 inches (78.7 mm). Detonator shell 12 may be made shorter, but generally will not exceed about 3.1 inches (78.7 mm) in length. Lengths B and C (FIG. 3) are measured along the longitudinal axis of detonator 10. Length B is the length of the explosive output charge 18 and may be from about 0.4 to about 1 inch (about 10 to 26 mm), e.g., about 0.8 to 1 inch (20 to 26 mm). Length C is the length of the pyrotechnic delay train member 20.

The inside diameter ID of detonator shell 12, and consequently the maximum diameter of explosive output charge 18, may vary from about 0.1 to about 0.196 inch (2.5 to 5 mm). For example, the inside diameter ID may vary from about 0.110 inch (2.8 mm) to about 0.150 inch (3.81 mm). The outside diameter OD of shell 12 may vary from about 0.130 inch (3.3 mm) to about 0.236 inch (6.0 mm), e.g., from about 0.132 inch (3.35 mm) to about 0.150 inch (3.81 mm). Usually, the thickness of the longitudinal wall of shell 12 is substantially uniform, so that both inside diameter ID and outside diameter OD are substantially constant.

By thus reducing the diameter and extending the length of explosive output charge 18 as compared to the explosive output charge of prior art constant diameter detonators, a significant degree of lateral explosive force is attained along the entire length B of charge 18. At the dimensions illustrated, and utilizing a conventional explosive such as PETN as explosive output charge 18, the lateral explosive force is comparable to that of detonating cord having a PETN core load of 33 grains per linear foot (108.3 grains per meter). This is a very significant explosive force which is capable of initiating a plurality of shock tubes or other receptor lines placed along the side of the detonator along the length B thereof as illustrated, for example, in FIGS. 3 and 4. In fact, the resultant explosive force has been found to be sufficiently great that in some surface applications, it is excessive. As is well known in the art, in large blasting operations, a large number of surface connectors comprising connector blocks (as described below) containing detonators are disposed throughout the blasting area to transfer signals to receptor lines attached thereto. It is desired to reduce the noise and shrapnel engendered by the detonation of, often, many hundreds of such detonators. Reduction of shrapnel is important (a connector block as described below aids in this effort) because shrapnel may sever a connecting line before the explosive signal has passed through it, thereby interrupting the desired sequence of explosions. In accordance with practices of the present invention, it may therefore be necessary or desirable to attenuate the explosive force of the detonator for use in some surface applications. Several expedients for doing so are described below.

Figure 2A:
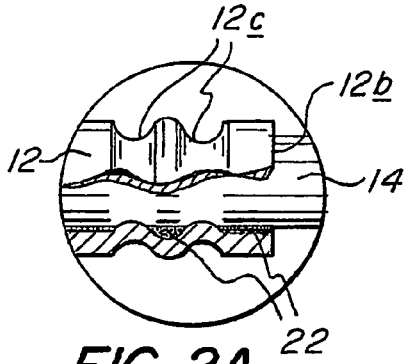
FIG. 2A is a view, enlarged relative to FIG. 2, of the portion of FIG. 2 enclosed by the circle A.

The inside diameter of shell 12 of detonator 10 may be selected to be identical or only very slightly larger than the outside diameter of the non-electric input signal transmission line which is received and sealed within the open end of shell 12. In the case of shock tube, a standard shock tube commercially available has an outside diameter of about 0.118 inch (3.00 mm) and commercially available mini shock tube has an outside diameter of about 0.085 inch (2.16 mm). By selecting an inside diameter ID of shell 12 which approximately corresponds to the outside diameter of the non-electric input signal transmission line, e.g., shock tube 14 of FIG. 2, the separate bushing required to close the open end 12*b* of shell 12 may be eliminated. The ID of shell 12 may thus be about 0.118 inch (3.00 mm) or slightly larger, to accommodate a standard size shock tube, or even as small as about 0.085 inch (2.16 mm) to accommodate mini shock tube. The latter size may, however, present problems in emplacing other components within the shell 12. In the embodiment illustrated in FIGS. 2 and 3, crimp 12*c* is formed in shell 12 to directly engage shock tube 14 to seal the interior of shell 12 from the environment. As best seen in FIG. 2A, a suitable sealant 22 may be applied between the exterior of shock tube 14 and the interior of shell 12 in the vicinity of crimp 12*c* to improve the effectiveness of the seal. Sealant 22 may be any suitable material such a curable adhesive or sealant or the like.

Aside from the relative dimensions of the length and diameter of shell 12 and of explosive output charge 18, and the resulting enhanced range of lateral explosive output, the construction and operation of detonator 10 are similar to prior art devices and therefore such need not be discussed in detail.

In accordance with the present invention, shell 12 is of constant diameter and has along its entire length a shell length-to-outside-diameter ratio much greater than that of prior art detonators. Typical of the detonators of the present invention, the shell 12 and the output charge 18 are configured so that output charge 18 has a high charge L:D ratio which is much greater than that of prior art constant-diameter detonators. In detonators according to the present invention, the charge L:D ratio is at least several times larger than that of such prior art detonators. For example, the charge L:D ratio may be about 3:1, 4:1, 5:1, 6:1, 7:1, 8:1, 9:1, 10:1, 12:1,20:1, 24:1, or any value between about 3:1 and about 24:1. In a particular embodiment, the charge L:D ratio is about 8.7:1. When a detonator is configured as described herein, it is possible to dispose a plurality of acceptor lines along the side of the detonator, all of which overlay the output charge, thereby achieving reliable signal transfer to each of them.

Generally, the dimensions and ratios of length to (outside) diameter of the shell 12 and of length-to-diameter ratio of the explosive output charge 18 as described above, apply as well to the other illustrated embodiments of the present invention.

FIG. 3 shows detonator 10 with one array of shock tubes 24 disposed transversely of the longitudinal axis thereof with all eight of the receptor lines, comprised in the illustrated embodiment of shock tubes 24, being disposed to be initiated by detonation of explosive output charge 18.

FIG. 3A is a cross-sectional view taken along line I—I of FIG. 3, and shows that, optionally, shock tubes 24 may be pressed into conforming contact with shell 12 of detonator 10 in the area of explosive charge 18. By "conforming contact" it is meant that shock tubes 24 are forced against shell 12 so that they make more than tangential contact therewith. A suitably designed connector block of the type illustrated in FIGS. 5 and 5A may be utilized for the purpose. In many cases, simple tangential contact will suffice.

Figure 4:
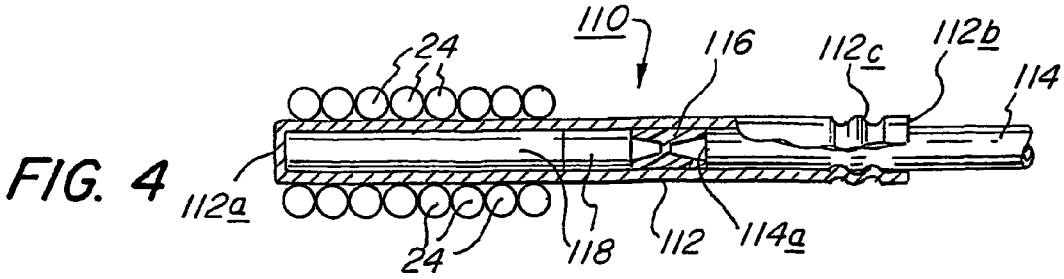
FIG. 4 is a schematic, cross-sectional side elevation view of a detonator in accordance with a second embodiment of the present invention, and showing two arrays of signal receptor lines positioned in contact with the detonator.

FIG. 4 shows another embodiment of the present invention comprising a detonator 110 which is substantially identical to that described in detail with respect to FIGS. 2 and 3, except that it lacks the equivalent of pyrotechnic delay train member 20 of the embodiment of FIGS. 2 and 3. Thus, detonator 110 is an instant-acting detonator and is comprised of a shell 112 having a closed end 112*a*, an open end 112*b*, and a crimp 112*c* which secures to detonator 110 a shock tube 114 which terminates in an end 114*a* which abuts an isolation member 116. Two arrays of eight receptor lines each comprising, in the illustrated embodiment, shock tubes 24, are disposed along the length of explosive output charge 118 for initiation by detonation of explosive output charge 118. It is seen that the number of receptor lines which can be initiated by a single detonator is increased as compared to prior art constant diameter detonators wherein at most only 6 or 8 receptor lines could be clustered about the explosive tip of a conventional detonator. Shock tubes 24 extend transversely of the longitudinal axis of detonator 110; in the illustrated embodiment, they are disposed perpendicularly thereto.

Figure 5:
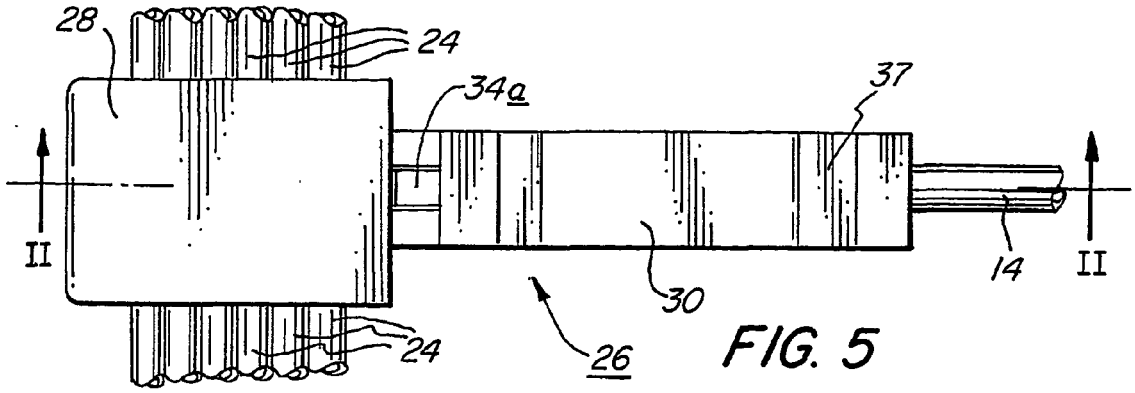
FIG. 5 is a top view of a connector block adapted to secure either one or two arrays of signal receptor lines in contact with a detonator in accordance with the present invention.
Figure 5A:
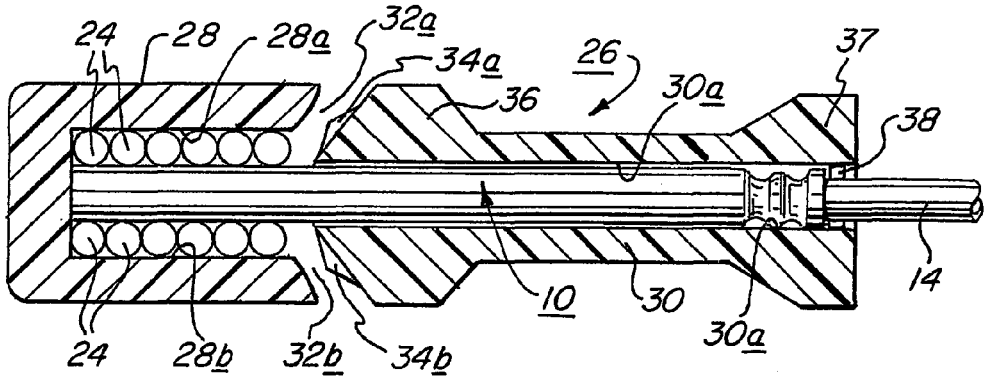
FIG. 5A is a cross-sectional side elevation view taken along line II—II of FIG. 5.

Referring now to FIGS. 5 and 5A, a connector block 26 has a tube-retaining member 28 affixed to one end of a body portion 30. As seen in FIG. 5A, body portion 30 has an enlarged head 36 and an enlarged tail 37. Body portion 30 also has a channel 30*a* extending therethrough and in which a detonator, e.g., detonator 10 of FIGS. 2 and 3, is received. Detonator 10, as described above, is provided with a non-electric signal transmission line comprising, in the illustrated embodiment, shock tube 14. As is well known in the art, a retainer 38 is formed within the portion of channel 30*a* contained within tail 37 in order to prevent withdrawal of detonator 10 from connector block 26. Tube-retaining member 28, as seen in FIG. 5A, has a pair of parallel tube-retaining slots 28*a*, 28*b* formed therein within which are received respective arrays of shock tubes 24, disposed perpendicularly to the longitudinal axis of detonator 10. A pair of tube entry slots 32*a* and 32*b* are formed to permit insertion of shock tubes 24 into, respectively, tube-retaining slots 28*a* and 28*b*. Protrusions 34*a*, 34*b* are formed on the sloped portions of head 36 within tube entry slots 32*a* and 32*b*. Protrusions 34*a*, 34*b* narrow the openings into tube-retaining slots 28*a* and 28*b* provided by tube entry slots 32*a* and 32*b* so that shock tubes 24 are temporarily slightly deformed as they are forced past protrusions 34*a* and 34*b*. The latter thereafter serve to prevent shock tubes 24 from being pulled out of tube-retaining slots 28*a*, 28*b* when tensile stresses are imposed on shock tubes 24 during preparation of a blast set-up, or otherwise.

For reasons of safety and economy, it is generally preferred, especially in surface applications, to employ detonators containing no more than the amount of explosive output charge material that is needed for reliable signal transfer. Conceivably, an explosive output charge having a charge L:D ratio in accordance with the present invention could be attained simply by filling a conventional detonator shell with a larger explosive output charge. That would not, however, be practical or, in some cases, possible, for a number of reasons. One is that the large quantity of explosive output charge that results would leave an insufficient length of shell to accommodate other components, such as a relatively long delay train member. As discussed above, the practically available length of a detonator shell is about 3.1 inches (78.7 mm), often only about 2.5 to about 3 inches (63.5 to 76.2 mm), and so there is only a limited amount of room within the detonator shell. Another reason is that such a quantity of explosive would provide much too large an explosive force for surface connector applications, creating too much shrapnel being propelled at great force, with concomitant risk of severing connected signal transfer lines. One feature of the present invention is that it provides a detonator shell configured to provide an explosive output charge with the desired high charge L:D ratio without substantially changing the overall output strength of the detonator, e.g., without the use of significant additional quantities of explosive material, as compared to prior art constant diameter detonators, and without incurring the problems associated with two-diameter detonators of the type illustrated in FIG. 1. TABLE I provides the result of calculations of the number of standard receptor lines, comprising shock tube having an outer diameter of 0.118 inch (3.00 mm), that can be arranged side-by-side along one side of the output region of a detonator to overlie explosive output charges of various lengths.

TABLE I

| | Embodiments of the Invention | | | | |
|---|---|---|---|---|---|
| | A | B | C | D | Prior Art |
| ID of Detonator Inches (mm) | 0.1 (2.54) | 0.10 (2.54) | 0.120 (3.05) | 0.130 (3.30) | 0.260 (6.60) |
| Charge Length Inches (mm) | 1.0 (25.4) | 0.860 (21.84) | 0.602 (15.29) | 0.514 (13.06) | 0.129 (3.28) |
| Charge L:D | 10.0:1 | 8.7:1 | 5.0:1 | 4.0:1 | 0.5:1 |
| Number of standard shock tube receptor lines accommodated on one side of the detonator for lateral initiation* | 8 | 7 | 5 | 4 | 1 |

*Calculated by dividing the charge length by 0.118 inch (3.00 mm), the outside diameter of a standard-size shock tube, and rounding down to the nearest whole number. The arrangement of the shock tubes is as illustrated in FIGS. 3 or 4.

If the dual-array arrangement of FIG. 3 is used, the number of standard shock tube receptor lines accommodated as shown in TABLE I, is doubled.

According to one embodiment of the present invention identified as embodiment C in TABLE I, a detonator shell having an inside diameter of 0.12 inch (3.05 mm) and an outside diameter of 0.15 inch (3.81 mm) contains an explosive output charge of lead azide with a charge length of 0.6 inch (15.29 mm). Such a detonator accommodates up to five standard receptor lines, which have outer diameters of 0.118 inch (3.00 mm) disposed alongside one side of the detonator coextensively with the explosive output charge in the manner illustrated in FIG. 4. Up to ten standard receptor lines can be accommodated using the arrangement of FIG. 3. Five such shock tubes placed side-by-side in abutting contact will occupy 5 times 3.00 mm or 15.00 mm of the 15.29 mm length of the explosive output charge.

Small-diameter detonator shells as exemplified by embodiments A through D of TABLE I cost considerably less to make than comparable conventional large-diameter detonator shells, and much less than comparable variable-diameter shells as shown in the above-described U.S. Pat. No. 6,349,648 and 6,305,287 and illustrated in FIG. 1. A typical two- to three-inch (50.8 to 76.2 mm) length of the shells of embodiments A through D could easily additionally accommodate other components of the detonator, e.g., a delay train member interposed between the end of an input signal transmission lines, e.g., a shock tube, connected to the detonator at the open end thereof, and the explosive output charge.

A pyrotechnic delay train member in the detonators of the present invention has a reduced size and cost as compared to a comparable conventional, larger-diameter pyrotechnic delay train. Such pyrotechnic delay train members comprise a charge of relatively slow-burning pyrotechnic material disposed within a metal tube. The pyrotechnic-containing tube may be made as a large-diameter tube which is drawn to reduce its diameter and thereby highly compress its pyrotechnic powder core to thereby reduce variations in burn time of the pyrotechnic, or the pyrotechnic may be pressed into a metal tube of desired diameter, or pressed into the detonator shell. Once the pyrotechnic-filled tube is drawn to its desired diameter, it is cut to length. The use of the small-diameter detonator shells of the present invention permits the drawing of the pyrotechnic-filled tube to a correspondingly small diameter, thereby obtaining a greater length of delay train for a given amount of pyrotechnic and metal material as compared to a larger diameter delay train member. For example, drawing a given metal-encased pyrotechnic core tube to a diameter of one-eighth inch (3.18 mm) yields from the same starting tube four times the length of delay train that would be obtained if the starting tube were drawn to a one-quarter inch (6.35 mm) diameter. The four-fold increase in yield is attained with no increase in materials cost and with substantially the same or only very slightly increased labor and processing costs. The cost of the delay train members is thus reduced on a per-unit length basis.

In addition, the detonators of the present invention may function with a smaller explosive output charge than prior art constant-diameter (large diameter) detonators, thereby reducing the cost of explosive per detonator as well as reducing the noise and generation of shrapnel, which is important when the detonator is used in surface applications.

Another way of increasing the charge L:D ratio with the same quantity of explosive is to use a greater volume of relatively low density explosive, such as PETN, instead of a higher-density explosive in the explosive output charge. For example, lead azide at a density of 3.0 g/cc may be replaced with PETN at a density of 1.5 g/cc. For another example, the output charge may comprise 130 milligrams PETN and 40 milligrams lead azide, instead of 170 mg lead azide. In one such embodiment, a shell with an interior diameter ("ID") of about 0.125 inch (3.18 mm) may hold an output charge comprising a combination of PETN and lead azide with a length of about 0.6 to about 1 inch (15.24 to 25.4 mm).

The lengths of explosive output charges of various overall densities in detonator shells having the inside diameters ("ID") indicated in TABLE I are shown in TABLE II.

TABLE II

Charge heights of 190 milligrams of explosive output charge at various Detonator IDs and charge densities

| Inside Diameter of Detonator | Average Density of Explosive Output Charge (g/cc) 1.7 g/cc | 1.8 g/cc | 1.9 g/cc | 2.2 g/cc | 3.0 g/cc |
|---|---|---|---|---|---|
| | Length of Explosive Output Charge Inch (mm) | | | | |
| 0.10 inch (2.54 mm) | 0.87 in. (22.10) | 0.82 in. (20.83) | 0.78 in. (19.81) | 0.67 in. (17.02) | 0.49 in. (12.45) |
| 0.12 inch (3.05 mm) | 0.60 in. (15.24) | 0.57 in. (14.48) | 0.54 in. (13.72) | 0.46 in. (11.68) | 0.34 in. (8.64) |
| 0.13 inch (3.30 mm) | 0.51 in. (12.95) | 0.48 in. (12.19) | 0.46 in. (11.68) | 0.40 in. (10.16) | 0.29 in. (7.37) |
| 0.260* inch (6.60 mm) | 0.13 in. (3.30) | 0.12 in. (3.05) | 0.11 in. (2.79) | 0.10 in. (2.54) | 0.07 in. (1.78) |

*Standard prior art detonator shell ID

Figure 6:
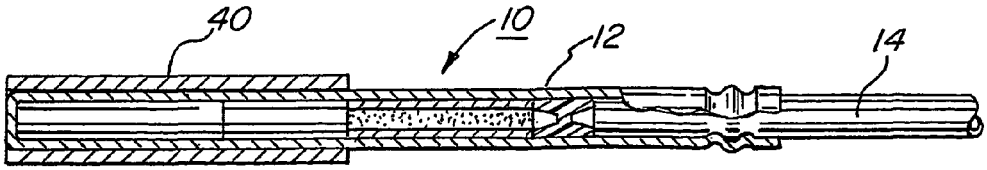
FIG. 6 is a schematic, cross-sectional side elevation view of detonator 10 of FIGS. 2 and 3 which, in accordance with a third embodiment of the present invention, has a short external attenuation sleeve attached thereto.

As noted above, especially in surface applications, e.g., applications which utilize a connector block such as that illustrated in FIGS. 5 and 5A, it is sometimes desired to attenuate the explosive output attained by the detonators of the present invention. One approach is simply to dilute the explosive output charge 18 with inert material, for example, to combine a pulverulent inert filler with the explosive powder, or to utilize a plastic bonded explosive as the explosive output charge 18 of the embodiment of FIGS. 2 and 3. Another expedient is shown in FIG. 6, which shows detonator 10 of FIGS. 2 and 3 fitted with an external attenuator sleeve 40. Attenuator sleeve 40 may be made from any suitable material, including aluminum, steel, or a synthetic polymeric material ("plastic"). It may be affixed to shell 12 of detonator 10 by any suitable means including a sealant or adhesive interposed between the interior of external attenuator sleeve 40 and the exterior of shell 12. In FIG. 6, not all the components are numbered, inasmuch as the components of detonator 10 were previously described in detail.

Figure 7:
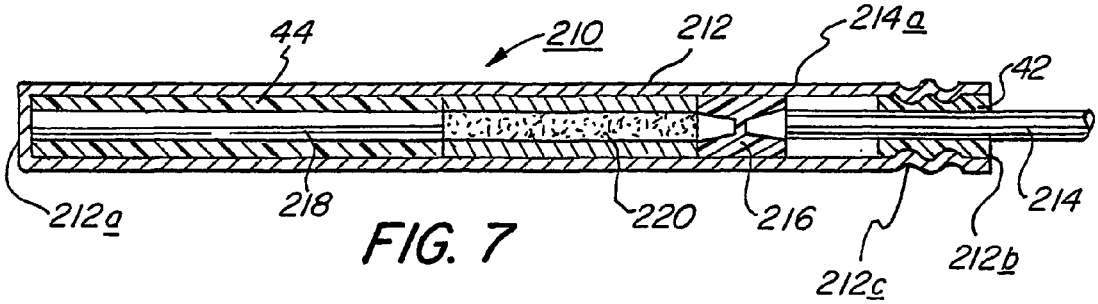
FIG. 7 is a schematic, cross-sectional side elevation view of a detonator in accordance with a fourth embodiment of the present invention.

FIG. 7 shows another embodiment for attenuating the force of the explosive output in which a detonator 210 is comprised of a shell 212 having a closed end 212*a*, an open end 212*b* and a crimp 212*c* formed about a bushing 42 which seals open end 212*b* about a non-electric input signal transmission line comprising, in the illustrated embodiment, a shock tube 214 which terminates in an end 214*a* An isolation member 216 is interposed between a pyrotechnic delay train member 220 and an explosive output charge 218 disposed within shell 212 at closed end 212*a* thereof. An internal attenuator sleeve 44 is positioned within shell 212. Internal attenuator sleeve 44 may be made of any suitable material, such as a plastic, and its presence adjacent the closed end 212*a* of shell 212 is seen to reduce the volume of explosive output charge 218, thereby attenuating the blast effect.

Figure 8:
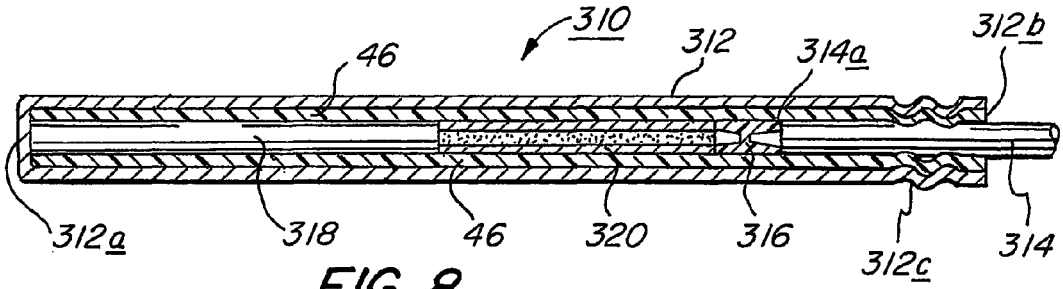
FIG. 8 is a schematic, cross-sectional side elevation view of a detonator in accordance with a fifth embodiment of the present invention.

FIG. 8 illustrates yet another embodiment of the invention showing a detonator 310 comprised of a shell 312 having a closed end 312*a*, an open end 312*b*, and crimp 312*c* which seals open end 312*b* about an incoming shock tube 314. As in the case of the embodiment of FIG. 7, isolation member 316 separates end 314*a* of shock tube 314 from pyrotechnic delay train member 320 which is disposed in signal transfer communication with explosive output charge 318 disposed within shell 312 at closed end 312*a* thereof. In this embodiment, an extended internal attenuator sleeve 46 extends from closed end 312*a* to open end 312*b* of shell 312. Extended internal attenuator sleeve 46 is made of any suitable compressible material, such as a plastic and, by being extended through the area of crimp 312*c*, serves as a replacement for the bushing 42 of the embodiment of FIG. 7. As is the case with the embodiment of FIG. 7, the presence of extended internal attenuator sleeve 46 reduces the volume of the explosive output charge 318.

Figure 9:
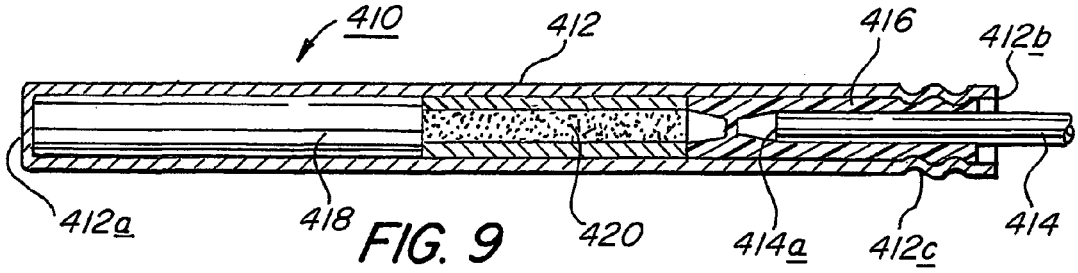
FIG. 9 is a schematic, cross-sectional side elevation view of a detonator in accordance with a sixth embodiment of the present invention.

FIG. 9 shows yet another embodiment of the present invention, in which a detonator 410 comprises a shell 412 having a closed end 412*a*, an open end 412*b* and a crimp 412*c*. Shock tube 414 terminates in an end 414*a* which faces an isolation member 416 which abuts pyrotechnic delay train member 420. In this embodiment, isolation member 416 extends to open end 412*b*, and crimp 412*c* is formed about isolation member 416, which thus serves both as an isolation member and a replacement for the separate bushing 42 of the embodiment of FIG. 7. Explosive output charge 418 is disposed at the closed end 412*a* of shell 412.

Figure 10:
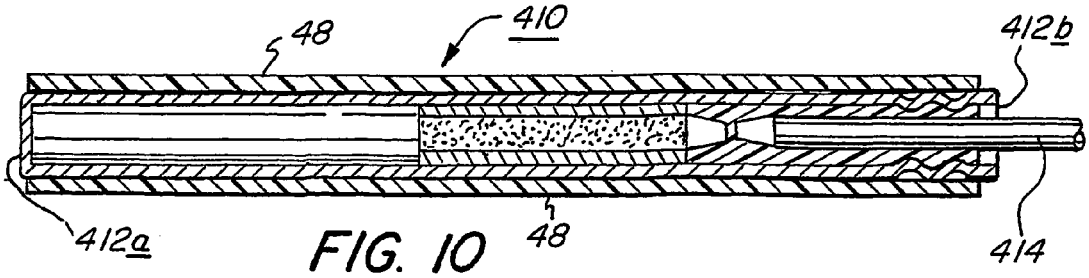
FIG. 10 is a schematic, cross-sectional side elevation view of detonator 410 of FIG. 9 which, in accordance with a seventh embodiment of the present invention, has a long external attenuation sleeve attached thereto.

FIG. 10 shows detonator 410 of FIG. 9 equipped with an extended external attenuator sleeve 48 which extends from closed end 412*a* to open end 412*b*. As compared to the short attenuator sleeve embodiment of FIG. 6, the FIG. 10 embodiment avoids a step-down in the outside diameter of the attenuator-equipped detonator. In FIG. 10, not all of the components are numbered, inasmuch as the components of detonator 410 were previously described in detail.

While the invention has been described herein with reference to particular embodiments thereof, it will be understood by one of ordinary skill in the art that numerous variations to the described embodiments will fall within the spirit of the invention and the scope of the appended claims.

What is claimed is:

1. A non-electric detonator comprising:

a one-piece cylindrical shell defining a shell interior, the shell having a substantially constant outside diameter not greater than about 6 mm, a closed end and an opposite, open end;

an explosive output charge contained within the shell at the closed end thereof, the entire explosive output charge being in the shape of a cylindrical column and having a charge L:D ratio of from about 3 to about 24; and a non-electric input signal transmission line received and sealed within the open end of the shell and disposed in signal-transfer relationship with the explosive charge.

2. A non-electric detonator comprising:

a one-piece cylindrical shell defining a shell interior and having a length as defined below, the shell being of substantially constant outside diameter not greater than about 6 mm, and having a closed end and an opposite, open end;

an explosive output charge contained entirely within the shell at the closed end thereof;

a non-electric input signal transmission line received and sealed within the open end of the shell and disposed in signal-transfer relationship with the explosive charge; and the length of the shell being such that the ratio of its length to its diameter is from about 8 to about 23.

3. The detonator of claim 1 or claim 2 wherein the shell has an outside diameter of from about 3.0 to about 5.5 mm.

4. The detonator of claim 3 wherein the length of the shell is from about 25 to about 79 mm.

5. The detonator of claim 1 or claim 2 wherein the length of the shell is from about 25 to about 79 mm.

6. The detonator of claim 1 or claim 2 wherein the explosive output charge is in the shape of a cylindrical column having a charge length-to-diameter ratio of from about 4 to about 10.

7. The detonator of claim 1 or claim 2 wherein the explosive output charge is in the shape of a cylindrical column having a length of from about 20 to about 26 mm.

8. The detonator of claim 7 wherein the explosive output charge has a diameter of from about 2.5 to about 5 mm.

9. The detonator of claim 1 or claim 2 wherein the input signal transmission line comprises shock tube.

10. The detonator of claim 1 or claim 2 further comprising a delay train member interposed between, and in signal-transfer relationship with, the explosive output charge and the input signal transmission line.

11. The detonator of claim 1 or claim 2 wherein the explosive output charge contains an inert diluent.

12. The detonator of claim 11 wherein the explosive output charge is substantially in the shape of a cylindrical column having a charge length-to-diameter ratio of from about 4 to 10.

13. The detonator of claim 11 wherein the explosive output charge has a length of about 20 to about 26 mm and a diameter of from about 2.5 to about 5 mm.

14. The detonator of claim 1 or claim 2 wherein the explosive output charge is in the shape of a cylindrical column and an attenuation sleeve is disposed about at least a portion of the length of the explosive charge.

15. The detonator of claim 14 wherein the attenuation sleeve is disposed within the shell.

16. The detonator of claim 14 wherein the attenuation sleeve is disposed on the exterior of the shell.

17. The detonator of claim 14 wherein the attenuation sleeve extends over the entire length of the explosive charge.

18. The detonator of claim 17 wherein the explosive output charge is in the shape of a cylindrical column having a charge length-to-diameter ratio of from about 4 to 10.

19. The detonator of claim 17 wherein the explosive output charge has a length of about 20 to about 26 mm and a diameter of from about 2.5 to about 5 mm.

20. The detonator of claim 1 or claim 2 wherein the shell has an inside diameter and the input-signal transmission line has an outside diameter which is substantially the same as the inside diameter of the shell.

21. The detonator of claim 20 wherein the shell has an inside wall and the detonator further comprises a sealant disposed between the input signal transmission line and the inside wall of the shell and disposed to seal the shell interior from the environment.

22. A non-electric detonator comprising:

a one-piece cylindrical shell defining a shell interior and having a closed end and an opposite, open end, the shell being of substantially constant outside diameter not greater than about 6 mm, and of substantially constant inside diameter;

an explosive output charge contained within the shell at the closed end thereof, the entire explosive output charge having the shape of a cylindrical column having a length of from about 10 to about 26 mm and a diameter of from about 2.5 to about 5 mm, provided however, that the length and diameter of the explosive output charge are selected to provide it with a charge L:D ratio of from about 3 to about 24; and a non-electric input signal transmission line received and sealed within the open end of the shell and terminating in an end disposed within the shell in signal-transfer relationship with the explosive charge.

23. The detonator of claim 22 further comprising a delay train interposed between, and in signal-transfer relationship with, the explosive charge and the input signal transmission line.

24. The detonator of claim 22 wherein the input signal transmission line comprises shock tube.

25. The detonator of claim 22 or claim 24 wherein the inside diameter of the shell is approximately equal to the outside diameter of the input signal transmission line and the shell is crimped onto the input signal transmission line.

26. The detonator of claim 25 wherein a sealant is interposed between the shell interior and the input signal transmission line at the location at which the shell is crimped to thereby seal the shell interior from the environment.

* * * * *